US006122382A

United States Patent [19]

Iida et al.

[11] Patent Number: 6,122,382

[45] Date of Patent: Sep. 19, 2000

[54] SYSTEM FOR PROCESSING AUDIO SURROUND SIGNAL

[75] Inventors: Toshiyuki Iida, Kawasaki; Tomohiro Mouri, Tokyo, both of Japan

[73] Assignee: Victor Company of Japan, Ltd., Yokohama, Japan

[21] Appl. No.: 08/947,350

[22] Filed: Oct. 8, 1997

[30] Foreign Application Priority Data

Oct. 11, 1996 [JP] Japan ..... 8-289351
May 9, 1997 [JP] Japan ..... 9-135941

[51] Int. Cl.[7] ..... H04R 5/00

[52] U.S. Cl. ..... 381/18; 381/17

[58] Field of Search ..... 381/1, 17, 18, 381/19, 20, 21, 22, 23, 63

[56] References Cited

U.S. PATENT DOCUMENTS

| | | | |
|---|---|---|---|
| 3,746,792 | 7/1973 | Scheiber . | |
| 4,159,397 | 6/1979 | Iwahara et al. | 381/19 |
| 4,188,504 | 2/1980 | Kasuga et al. . | |
| 4,349,698 | 9/1982 | Iwahara | 381/1 |
| 5,123,050 | 6/1992 | Serikawa et al. | 381/63 |
| 5,173,944 | 12/1992 | Begualt | 381/17 |
| 5,216,718 | 6/1993 | Fukuda | 381/63 |
| 5,261,005 | 11/1993 | Masayuki | 381/63 |
| 5,404,406 | 4/1995 | Fuchigami et al. | 381/17 |
| 5,524,053 | 6/1996 | Iwamatsu | 381/63 |
| 5,546,465 | 8/1996 | Kim | 381/18 |
| 5,579,396 | 11/1996 | Iida et al. | 381/18 |
| 5,604,809 | 2/1997 | Tsubonuma et al. | 381/63 |
| 5,657,391 | 8/1997 | Jyosako | 381/63 |
| 5,680,464 | 10/1997 | Iwamatsu | 381/18 |
| 5,727,067 | 3/1998 | Iwamatsu | 381/18 |
| 5,872,851 | 2/1999 | Petroff | 381/18 |

FOREIGN PATENT DOCUMENTS

| | | |
|---|---|---|
| 6-233394 | 8/1994 | Japan . |
| 8-205297 | 8/1996 | Japan . |
| 8-051698 | 9/1996 | Japan . |
| 8-336199 | 12/1996 | Japan . |

OTHER PUBLICATIONS

AC–3 "Flexible Perceptual Coding for Audio Transmission and Storage" by Craig C. Todd et al; Presented at the 96th Convention 1994 Feb. 26–Mar. 1, Amsterdam An Audio Engineering Society Preprint.

*Primary Examiner*—Forester W. Isen
*Assistant Examiner*—Xu Mei
*Attorney, Agent, or Firm*—Pollock, Vande Sande & Amernick

[57] ABSTRACT

A multiplexing-resultant surround signal is decoded into multiple-channel signals including at least a first left-channel signal, a first right-channel signal, and a rear-channel signal. Samples of the rear-channel signal are thinned out to generate a thinning-resultant rear-channel signal. The thinning-resultant rear-channel signal is subjected to a given process to convert the thinning-resultant rear-channel signal into a left surround-related signal and a right surround-related signal. The given process is designed to localize sound images at rear positions with respect to a listener when a rear loudspeaker is absent and only front loudspeakers are used. A surround-effect-added left-channel signal is generated on the basis of the first left-channel signal and the left surround-related signal. A surround-effect-added right-channel signal is generated on the basis of the first right-channel signal and the right surround-related signal.

24 Claims, 14 Drawing Sheets

SYSTEM FOR PROCESSING AUDIO SURROUND SIGNAL

BACKGROUND OF THE INVENTION

1. Field of the Invention

This invention relates to a system for processing a surround signal. This invention relates to a method of processing a surround signal. This invention relates to an information recording medium which stores a surround signal processing program. This invention relates to a transmission system for a surround signal processing program. This invention relates to a reception system for a surround signal processing program. This invention relates to an apparatus for recording a surround signal. This invention relates to a method of recording a surround signal. This invention relates to a recording apparatus for a surround signal processing program.

2. Description of the Related Art

Systems for recovering multiple-channel audio signals are of several types such as the 3-1 type in High-Vision and the 4-channel matrix type based on Dolby surround. Many motion-picture films have surround tracks which carry surround information resulting from Dolby surround audio processing. In a motion-picture theater, sound information is reproduced from a surround track, and the reproduced sound information is decoded into multiple-channel sound signals. The sound signals are fed to loudspeakers before being converted into corresponding sounds, respectively. The loudspeakers include front loudspeakers and also a rear loudspeaker to provide the surround effect.

There are commercially available video tapes and laser discs which are made on the basis of such motion-picture films by steps including a step of copying sound information. These video tapes and laser discs store sound information which results from surround audio processing such as Dolby surround audio processing.

During the reproduction of information from a conventional package recording medium having a surround track, sound information is reproduced from the surround track, and is decoded into 4-channel signals of Dolby surround. It is known to convert such 4-channel signals into only 2-channel signals for a typical audio system without any rear loudspeaker. The 2-channel signals are fed to two front loudspeakers, respectively. The conversion of the 4-channel signals into the 2-channel signals is designed to provide a virtual rear loudspeaker for the surround effect.

Japanese published unexamined patent applications 6-233394 and 8-51698 disclose such surround signal processors having stages for converting 4-channel signals into 2-channel signals. Generally, the surround signal processors in Japanese applications 6-233394 and 8-51698 are required to process input signals at high rates since they implement neither signal compression processes nor signal thinning processes.

SUMMARY OF THE INVENTION

It is an object of this invention to provide an improved system for processing an audio surround signal.

A first aspect of this invention provides a surround signal processing system comprising first means for decoding a multiplexing-resultant surround signal into multiple-channel signals including at least a first left-channel signal, a first right-channel signal, and a rear-channel signal; second means for thinning out samples of the rear-channel signal generated by the first means to generate a thinning-resultant rear-channel signal; third means for subjecting the thinning-resultant rear-channel signal to a given process to convert the thinning-resultant rear-channel signal into a left surround-related signal and a right surround-related signal, the given process being designed to localize sound images at rear positions with respect to a listener when a rear loudspeaker is absent and only front loudspeakers are used; fourth means for generating a surround-effect-added left-channel signal on the basis of the first left-channel signal generated by the first means and the left surround-related signal generated by the third means; and fifth means for generating a surround-effect-added right-channel signal on the basis of the first right-channel signal generated by the first means and the right surround-related signal generated by the third means.

A second aspect of this invention provides a method of processing a surround signal, comprising the steps of decoding a multiplexing-resultant surround signal into multiple-channel signals including at least a first left-channel signal, a first right-channel signal, and a rear-channel signal; thinning out samples of the rear-channel signal generated by the decoding step to generate a thinning-resultant rear-channel signal; subjecting the thinning-resultant rear-channel signal to a given process to convert the thinning-resultant rear-channel signal into a left surround-related signal and a right surround-related signal, the given process being designed to localize sound images at rear positions with respect to a listener when a rear loudspeaker is absent and only front loudspeakers are used; generating a surround-effect-added left-channel signal on the basis of the first left-channel signal generated by the decoding step and the left surround-related signal generated by the subjecting step; and generating a surround-effect-added right-channel signal on the basis of the first right-channel signal generated by the decoding step and the right surround-related signal generated by the subjecting step.

A third aspect of this invention provides an information recording medium which stores a program of processing a multiplexing-resultant surround signal, the program including a step of decoding a multiplexing-resultant surround signal into multiple-channel signals including at least a first left-channel signal, a second right-channel signal, and a rear-channel signal; a step of thinning out samples of the rear-channel signal generated by the decoding step to generate a thinning-resultant rear-channel signal; a step of subjecting the thinning-resultant rear-channel signal to a given process to convert the thinning-resultant rear-channel signal into a left surround-related signal and a right surround-related signal, the given process being designed to localize sound images at rear positions with respect to a listener when a rear loudspeaker is absent and only front loudspeakers are used; a step of generating a surround-effect-added left-channel signal on the basis of the first left-channel signal generated by the decoding step and the left surround-related signal generated by the subjecting step; and a step of generating a surround-effect-added right-channel signal on the basis of the first right-channel signal generated by the decoding step and the right surround-related signal generated by the subjecting step.

A fourth aspect of this invention provides a transmission system for a surround signal processing program, comprising first meas for storing a program of processing a surround signal, the program including a step of decoding a multiplexing-resultant surround signal into multiple-channel signals including at least a first left-channel signal, a first right-channel signal, and a rear-channel signal; a step of thinning out samples of the rear-channel signal generated by the decoding step to generate a thinning-resultant rear-channel signal; a step of subjecting the thinning-resultant rear-channel signal to a given process to convert the thinning-resultant rear-channel signal into a left surround-related signal and a right surround-related signal, the given process being designed to localize sound images at rear positions with respect to a listener when a rear loudspeaker is absent and only front loudspeakers are used; a step of generating a surround-effect-added left-channel signal on the basis of the first left-channel signal generated by the decoding step and the left surround-related signal generated by the subjecting step; and a step of generating a surround-effect-added right-channel signal on the basis of the first right-channel signal generated by the decoding step and the right surround-related signal generated by the subjecting step; a terminal device connected to a communication network; and second means connected to the first means and the terminal device for transmitting the program from the first means to the communication network via the terminal device.

A fifth aspect of this invention provides a reception system for a surround signal processing program, comprising a terminal device connected to a communication network; and means connected to the terminal device for receiving a program from the communication network via the terminal device; wherein the program includes a step of decoding a multiplexing-resultant surround signal into multiple-channel signals including at least a first left-channel signal, a first right-channel signal, and a rear-channel signal; a step of thinning out samples of the rear-channel signal generated by the decoding step to generate a thinning-resultant rear-channel signal; a step of subjecting the thinning-resultant rear-channel signal to a given process to convert the thinning-resultant rear-channel signal into a left surround-related signal and a right surround-related signal, the given process being designed to localize sound images at rear positions with respect to a listener when a rear loudspeaker is absent and only front loudspeakers are used; a step of generating a surround-effect-added left-channel signal on the basis of the first left-channel signal generated by the decoding step and the left surround-related signal generated by the subjecting step; and a step of generating a surround-effect-added right-channel signal on the basis of the first right-channel signal generated by the decoding step and the right surround-related signal generated by the subjecting step.

A sixth aspect of this invention provides a recording apparatus for a surround signal, comprising first means for decoding a multiplexing-resultant surround signal into multiple-channel signals including at least a first left-channel signal, a first right-channel signal, and a rear-channel signal; second means for thinning out samples of the rear-channel signal generated by the first means to generate a thinning-resultant rear-channel signal; third means for subjecting the thinning-resultant rear-channel signal to a given process to convert the thinning-resultant rear-channel signal into a left surround-related signal and a right surround-related signal, the given process being designed to localize sound images at rear positions with respect to a listener when a rear loudspeaker is absent and only front loudspeakers are used; fourth means for generating a surround-effect-added left-channel signal on the basis of the first left-channel signal generated by the first means and the left surround-related signal generated by the third means; fifth means for generating a surround-effect-added right-channel signal on the basis of the first right-channel signal generated by the first means and the right surround-related signal generated by the third means; and sixth means for recording the surround-effect-added left-channel signal and the surround-effect-added right-channel signal on a recording medium.

A seventh aspect of this invention provides a method of recording a surround signal, comprising the steps of decoding a multiplexing-resultant surround signal into multiple-channel signals including at least a first left-channel signal, a first right-channel signal, and a rear-channel signal; thinning out samples of the rear-channel signal generated by the decoding step to generate a thinning-resultant rear-channel signal; subjecting the thinning-resultant rear-channel signal to a given process to convert the thinning-resultant rear-channel signal into a left surround-related signal and a right surround-related signal, the given process being designed to localize sound images at rear positions with respect to a listener when a rear loudspeaker is absent and only front loudspeakers are used; generating a surround-effect-added left-channel signal on the basis of the first left-channel signal generated by the decoding step and the left surround-related signal generated by the subjecting step; generating a surround-effect-added right-channel signal on the basis of the first right-channel signal generated by the decoding step and the right surround-related signal generated by the subjecting step; and recording the surround-effect-added left-channel signal and the surround-effect-added right-channel signal on a recording medium.

An eighth aspect of this invention provides a recording apparatus for a surround signal processing program, comprising first means for encoding a surround signal processing program into an encoding-resultant signal having a form suited for record; and second means for recording the encoding-resultant signal generated by the first means on an information recording medium; wherein the surround signal processing program includes a step of decoding a multiplexing-resultant surround signal into multiple-channel signals including at least a first left-channel signal, a first right-channel signal, and a rear-channel signal; a step of thinning out samples of the rear-channel signal generated by the decoding step to generate a thinning-resultant rear-channel signal; a step of subjecting the thinning-resultant rear-channel signal to a given process to convert the thinning-resultant rear-channel signal into a left surround-related signal and a right surround-related signal, the given process being designed to localize sound images at rear positions with respect to a listener when a rear loudspeaker is absent and only front loudspeakers are used; a step of generating a surround-effect-added left-channel signal on the basis of the first left-channel signal generated by the decoding step and the left surround-related signal generated by the subjecting step; and a step of generating a surround-effect-added right-channel signal on the basis of the first right-channel signal generated by the decoding step and the right surround-related signal generated by the subjecting step.

DESCRIPTION OF THE PREFERRED EMBODIMENTS

First Embodiment

Figure 1:
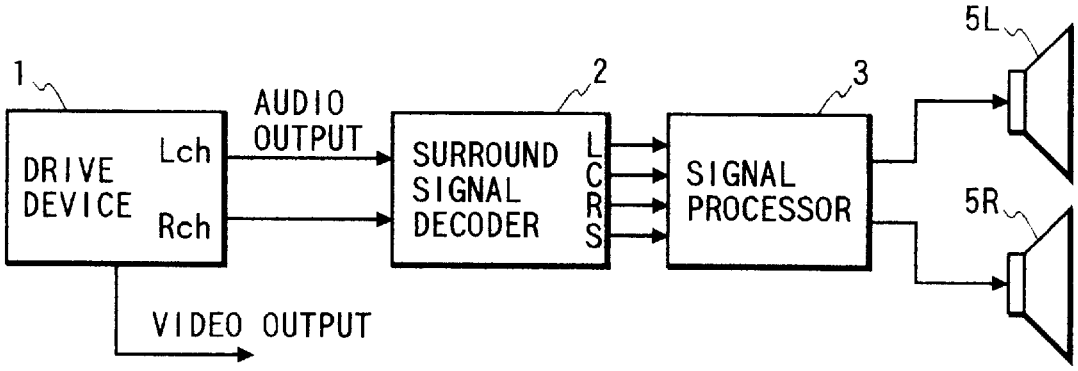
FIG. 1 is a block diagram of a surround signal processing system according to a first embodiment of this invention.

With reference to FIG. 1, a drive device 1 reads out a video signal and an audio signal from a recording medium such as a video tape or a laser disc which is made on the basis of a motion-picture film having a surround track. The drive device 1 outputs the readout video signal to a display (not shown). The drive device 1 outputs the readout audio signal. The audio signal outputted from the drive device 1 has a left-channel audio signal Lch and a right-channel audio signal Rch.

The audio signal outputted from the drive device 1 agrees with a multiplexing-resultant audio signal which is generated by encoding and multiplexing a left-channel audio signal, a right-channel audio signal, a center-channel audio signal, and a rear-channel audio signal (a rear surround signal). The multiplexing-resultant audio signal is also referred to as a multiplexing-resultant surround signal or a surround signal.

The surround signal decoder 2 receives the left-channel audio signal Lch and the right-channel audio signal Rch from the drive device 1, and decodes the received signals Lch and Rch into a left signal L, a right signal R, a center signal C, and a rear signal (a rear-channel signal or a rear surround signal) S in a known way. The surround signal decoder 2 outputs the left signal L, the right signal R, the center signal C, and the rear surround signal S to a signal processor 3.

The signal processor 3 converts the left signal L, the right signal R, the center signal C, and the rear surround signal S into a pair of a surround-effect-added left signal and a surround-effect-added right signal. The signal processor 3 outputs the surround-effect-added left signal and the surround-effect-added right signal to a left loudspeaker 5L and a right loudspeaker 5R, respectively.

The left loudspeaker 5L converts the surround-effect-added left signal into corresponding sound. The right loudspeaker 5R converts the surround-effect-added right signal into corresponding sound.

Generally, the left loudspeaker 5L and the right loudspeaker 5R are placed in front of the listener. As will be made clear later, the surround-effect-added signals applied to the front loudspeakers 5L and 5R are designed to provide a virtual rear left loudspeaker and a virtual rear right loudspeaker which enable the surround effects. In addition, the surround-effect-added signals are designed to provide a virtual front center loudspeaker.

Figure 2:
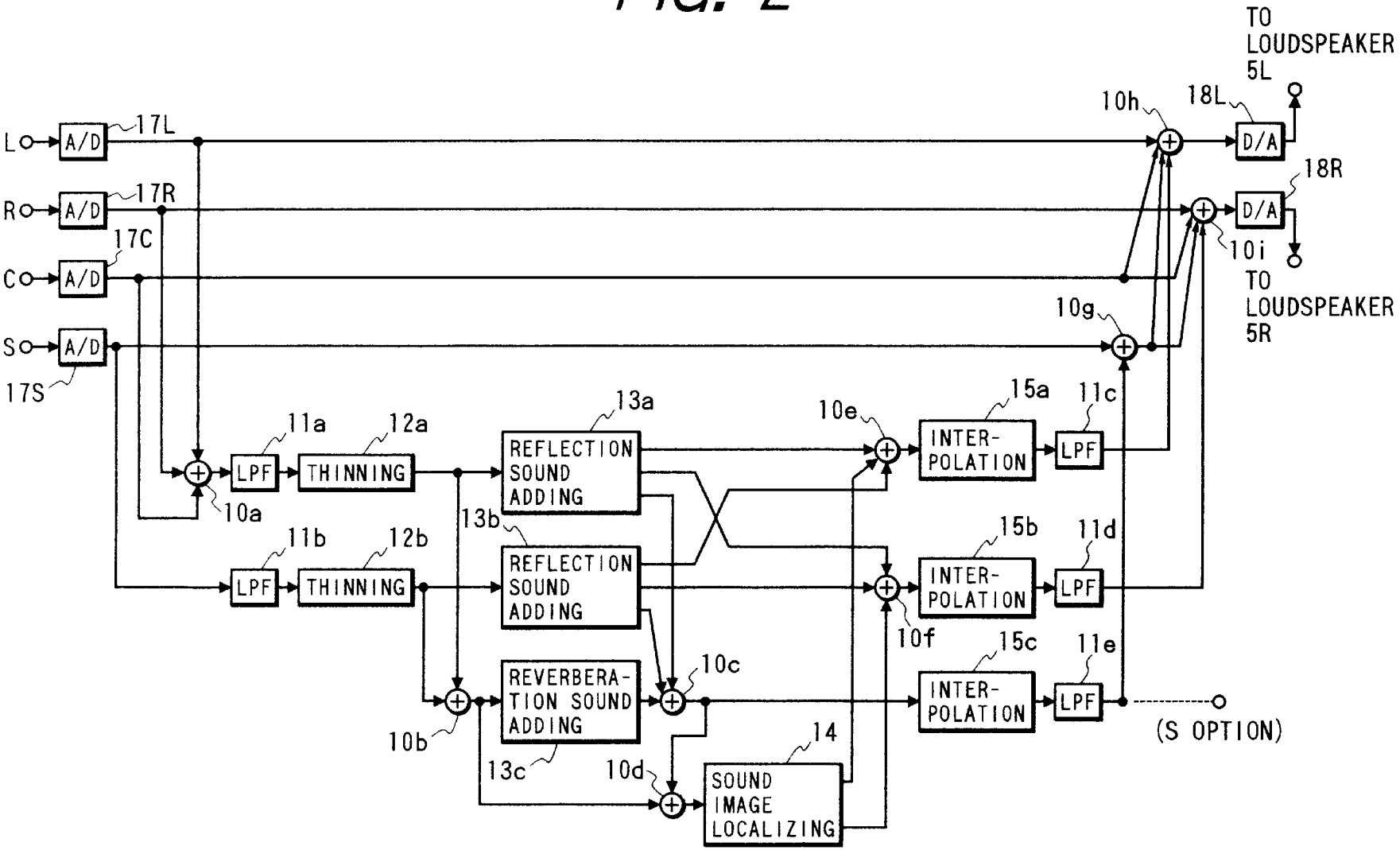
FIG. 2 is a flow diagram of operation of a signal processor in FIG. 1.

The signal processor 3 includes a digital signal processor (a DSP) or a similar device which has a combination of an input/output port, a processing section, a ROM, and a RAM. The signal processor 3 operates in accordance with a program stored in the ROM. It is a common practice to explain program-based operation of such a DSP with reference to an operation flow diagram. FIG. 2 is a diagram of the flow of operation of the signal processor 3. It should be noted that FIG. 2 does not directly show the hardware structure of the signal processor 3.

With reference to FIG. 2, an A/D (analog-to-digital) converting section 17L periodically samples the left signal L at a predetermined sampling frequency, and changes every sample of the left signal L into a corresponding digital sample (a digital left signal). The predetermined sampling frequency is equal to, for example, 44.1 kHz. An A/D (analog-to-digital) converting section 17R periodically samples the right signal R at the predetermined sampling frequency, and changes every sample of the right signal R into a corresponding digital sample (a digital right signal). An A/D (analog-to-digital) converting section 17C periodically samples the center signal C at the predetermined sampling frequency, and changes every sample of the center signal C into a corresponding digital sample (a digital center signal). An A/D (analog-to-digital) converting section 17S periodically samples the rear surround signal S at the predetermined sampling frequency, and changes every sample of the rear surround signal S into a corresponding digital sample (a digital rear surround signal).

The digital left signal, the digital right signal, and the digital center signal generated by the A/D converting sections 17L, 17R, and 17C are added and combined by a block 10*a*. The addition-resultant signal generated by the block 10*a* is subjected to a low pass filtering process by a block 11*a*. The low pass filtering process implements anti-aliasing with respect to a thinning process in a later stage. The filtering-resultant signal generated by the block 11*a* is subjected to a thinning process (a decimation process) by a block 12*a*. For example, first alternate samples of the filtering-resultant signal are discarded by the block 12*a* while second alternate samples of the filtering-resultant signal are selected by the block 12*a*. Accordingly, in this case, only the second alternate samples will be used in a later stage.

The digital rear surround signal generated by the A/D converting section 17S is subjected to a low pass filtering process by a block 11*b*. The low pass filtering process implements anti-aliasing with respect to a thinning process in a later stage. The filtering-resultant signal generated by the block 11*b* is subjected to a thinning process (a decimation process) by a block 12*b*. For example, first alternate samples of the filtering-resultant signal are discarded by the block 12*b* while second alternate samples of the filtering-resultant signal are selected by the block 12*b*. Accordingly, in this case, only the second alternate samples will be used in a later stage.

The thinning-resultant signal generated by the block 12*a* is subjected by a block 13*a* to an initial reflection sound adding process. The block 13*a* generates a first processing-resultant signal, a second processing-resultant signal, and a third processing-resultant signal on the basis of the thinning-resultant signal.

The thinning-resultant signal generated by the block 12*b* is subjected by a block 13*b* to an initial reflection sound adding process. The block 13*b* generates a first processing-resultant signal, a second processing-resultant signal, and a third processing-resultant signal on the basis of the thinning-resultant signal.

The thinning-resultant signal generated by the block 12*a* and the thinning-resultant signal generated by the block 12*b* are added and combined by a block 10*b*. The addition-resultant signal generated by the block 10*b* is subjected by a block 13*c* to a reverberation sound adding process.

The third processing-resultant signal generated by the block. 13*a*, the third processing-resultant signal generated by the block 13*b*, and the processing-resultant signal generated by the block 13*c* are added and combined by a block 10*c*. The addition-resultant signal generated by the block 10*b* and the addition-resultant signal generated by the block 10*c* are added and combined by a block 10*d*. The addition-resultant signal generated by the block 10*d* is subjected by a block 14 to a sound image localizing process. The sound image localizing process is designed to provide sound images at a rear left position and a rear right position symmetrical with respect to a listener. The block 14 generates a first processing-resultant signal and a second processing-resultant signal on the basis of the addition-resultant signal generated by the block 10*d*.

The first processing-resultant signal generated by the block 13*a*, the first processing-resultant signal generated by the block 13*b*, and the first processing-resultant signal generated by the block 14 are added and combined by a block 10*e*. The addition-resultant signal generated by the block 10*e* is subjected to interpolation by a block 15*a*. For example, the block 15*a* copies every sample of the addition-resultant signal generated by the block 10*e*, and places the copy-resultant sample at a temporal position corresponding to a sample discarded by the block 12*a* or 12*b*. Thus, the block 15*a* doubles the number of samples by a copying process. The interpolation-resultant signal generated by the block 15*a* is subjected to a low pass filtering process by a block 11*c*. The low pass filtering process implements anti-aliasing.

The second processing-resultant signal generated by the block 13*a*, the second processing-resultant signal generated by the block 13*b*, and the second processing-resultant signal generated by the block 14 are added and combined by a block 10*f*. The addition-resultant signal generated by the block 10*f* is subjected to interpolation by a block 15*b*. For example, the block 15*b* copies every sample of the addition-resultant signal generated by the block 10*f*, and places the copy-resultant sample at a temporal position corresponding to a sample discarded by the block 12*a* or 12*b*.

Thus, the block 15*b* doubles the number of samples by a copying process. The interpolation-resultant signal generated by the block 15*b* is subjected to a low pass filtering process by a block 11*d*. The low pass filtering process implements anti-aliasing.

The addition-resultant signal generated by the block 10*c* is subjected to interpolation by a block 15*c*. For example, the block 15*c* copies every sample of the addition-resultant signal generated by the block 10*c*, and places the copy-resultant sample at a temporal position corresponding to a sample discarded by the block 12*a* or 12*b*. Thus, the block 15*c* doubles the number of samples by a copying process. The interpolation-resultant signal generated by the block 15*c* is subjected to a low pass filtering process by a block 11*e*. The low pass filtering process implements anti-aliasing. The digital rear surround signal generated by the A/D converting section 17S and the filtering-resultant signal generated by the block 11*e* are added and combined by a block 10*g*. The digital left signal generated by the A/D converting section 17L, the addition-resultant signal generated by the block 10*g*, the digital center signal generated by the A/D converting section 17C, and the filtering-resultant signal generated by the block 11*c* are added and combined by a block 10*h* into a surround-effect-added digital left signal. A D/A converting section 18L changes the surround-effect-added digital left signal into a corresponding surround-effect-added analog left signal. The D/A converting section 18L outputs the surround-effect-added analog left signal to the left loudspeaker 5L. The digital right signal generated by the A/D converting section 17R, the addition-resultant signal generated by the block 10*g*, the digital center signal generated by the A/D converting section 17C, and the filtering-resultant signal generated by the block 11*d* are added and combined by a block 10*i* into a surround-effect-added digital right signal. A D/A converting section 18R changes the surround-effect-added digital right signal into a corresponding surround-effect-added analog right signal. The D/A converting section 18R outputs the surround-effect-added analog right signal to the right loudspeaker 5R.

It should be noted that the filtering-resultant signal generated by the block 11*e* may be outputted to an external device as an option.

Figure 3:
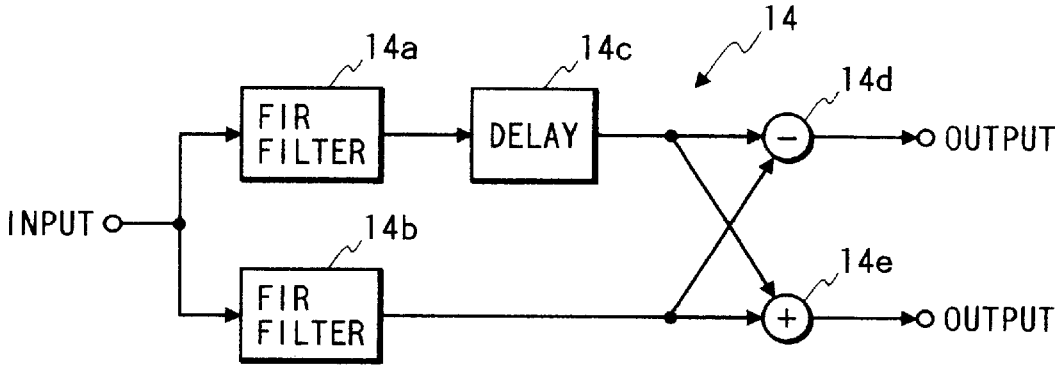
FIG. 3 is an operation flow diagram of a first example of a sound-image localizing block in FIG. 2.

FIG. 3 shows a first example of the block 14 for the sound image localizing process. As shown in FIG. 3, the first example of the block 14 has sub blocks 14*a*, 14*b*, 14*c*, 14*d*, and 14*e*. The addition-resultant signal generated by the block 10*d* (see FIG. 2) is subjected by the sub block 14*a* to an FIR filtering process which corresponds to a transfer characteristic P. The filtering-resultant signal generated by the sub block 14*a* is delayed by the sub block 14*c*. The delay provided by the sub block 14*c* corresponds to a time in the range of, for example, 0 to 20 msec. Also, the addition-resultant signal generated by the block 10*d* (see FIG. 2) is subjected by the sub block 14*b* to an FIR filtering process which corresponds to a transfer characteristic N. The sub block 14*d* subtracts the filtering-resultant signal generated by the sub block 14*b* from the delay-resultant signal generated by the sub block 14*c* to generate a signal representing the difference therebetween. The subtraction-resultant signal generated by the sub block 14*d* is used by the block 10*e* (see FIG. 2). The sub block 14*e* adds the filtering-resultant signal generated by the sub block 14*b* and the delay-resultant signal generated by the sub block 14*c* to generate a signal representing the addition therebetween. The addition-resultant signal generated by the sub block 14*e* is used by the block 10*f* (see FIG. 2).

The transfer characteristics P and N are given as follows.

$$P=(F+K)/(S+A)$$

$$N=(F-K)/(S-A)$$

where "S" denotes the transfer function of a sound path from the left loudspeaker 5L to the left ear of the listener, and also the transfer function of a sound path from the right loudspeaker 5R to the right ear of the listener; "A" denotes the transfer function of a sound path from the right loudspeaker 5R to the left ear of the listener; and also the transfer function of a sound path from the left loudspeaker 5L to the right ear of the listener; "F" denotes the transfer function of a sound path from a desired position of a localized rear left sound image to the left ear of the listener, and also the transfer function of a sound path from a desired position of a localized rear right sound image to the right ear of the listener, and "K" denotes the transfer function of a sound path from the desired position of the localized rear left sound image to the right ear of the listener and the transfer function of a sound path from the desired position of the localized rear right sound image to the left ear of the listener.

Figure 4:
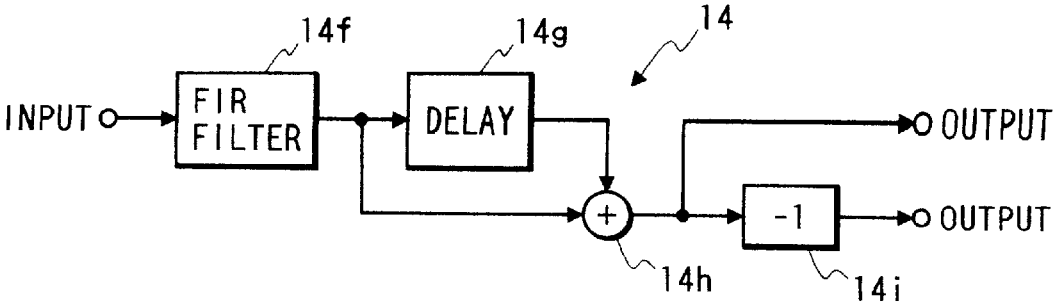
FIG. 4 is an operation flow diagram of a second example of the sound-image localizing block in FIG. 2.

FIG. 4 shows a second example of the block 14 for the sound image localizing process. As shown in FIG. 4, the second example of the block 14 has sub blocks 14*f*, 14*g*, 14*h*, and 14*i*. The addition-resultant signal generated by the block 10*d* (see FIG. 2) is subjected by the sub block 14*f* to an FIR filtering process which corresponds to a transfer characteristic N. The filtering-resultant signal generated by the sub block 14*f* is delayed by the sub block 14*g*. The delay provided by the sub block 14*g* corresponds to a time in the range of, for example, 0 to 20 msec. The filtering-resultant signal generated by the sub block 14*f* and the delay-resultant signal generated by the sub block 14*g* are added and combined by the sub block 14*h*. The addition-resultant signal generated by the sub block 14*h* is used by the block 10*e* (see FIG. 2). The addition-resultant signal generated by the sub block 14*h* is inverted by the sub block 14*i*. The inversion-resultant signal generated by the sub block 14*i* is used by the block 10*f* (see FIG. 2).

Figure 5:
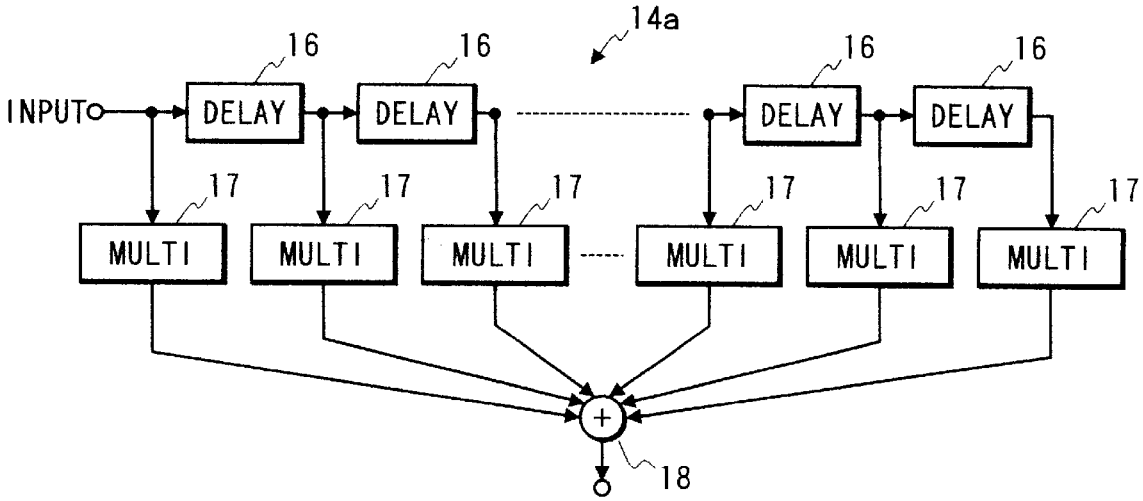
FIG. 5 is an operation flow diagram of an FIR filtering block in FIG. 3.

The blocks 14*a*, 14*b*, and 14*f* for the FIR filtering processes in FIGS. 3 and 4 are similar to each other in internal design. Accordingly, only the sub block 14*a* will be explained in detail. As shown in FIG. 5, the sub block 14*a* has a combination of delay steps 16, coefficient multiplying steps 17, and an adding step 18. The delay steps 16 are connected in series. The delay step connection has taps which are followed by the coefficient multiplying steps 17 respectively. Signals generated by the coefficient multiplying steps 17 are added by the adding step 18. A signal generated by the adding step 18 is used by the sub block 14*c* in FIG. 3.

The FIR filtering process implemented by the sub block 14*a* relates to a filter coefficient Hl while the FIR filtering process implemented by the sub block 14*b* relates to a filter coefficient Hr. The filter coefficients Hl and Hr are given as follows.

$$Hl=(SF-AK)/(S^2-A^2)$$

$$Hr=(SK-AF)/(S^2-A^2)$$

Figure 6:
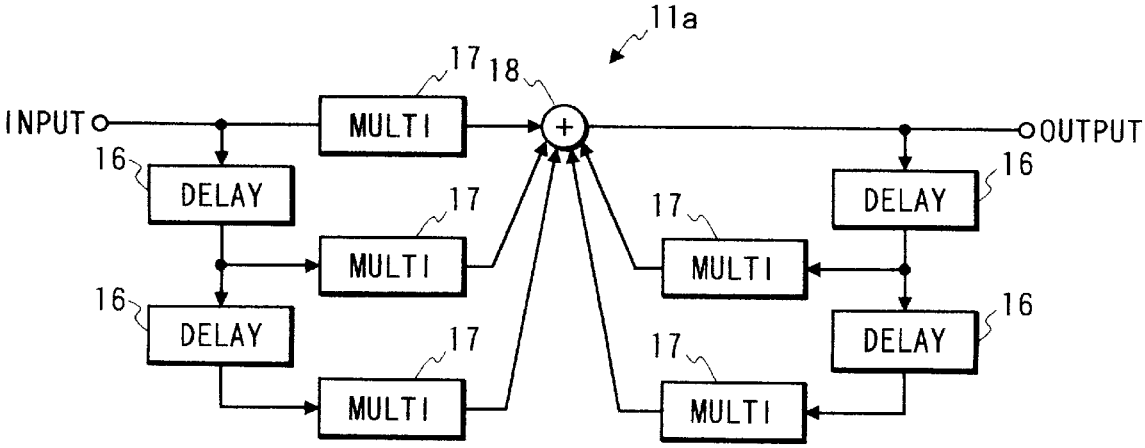
FIG. 6 is an operation flow diagram of a low pass filtering block in FIG. 2.

With reference back to FIG. 2, the blocks 11*a*, 11*b*, 11*c*, 11*d*, and 11*e* for the low pass filtering processes are similar to each other in internal design. Accordingly, only the block 11*a* will be explained in detail. As shown in FIG. 6, the block 11*a* has a known combination of delay steps 16, coefficient multiplying steps 17, and an adding step 18.

The block 14 and the related blocks in FIG. 2 serve to generate a left surround signal and a right surround signal on the basis of the single surround signal S. The left surround signal is added to the left signal fed to the left loudspeaker 5L while the right surround signal is added to the right signal fed to the right loudspeaker 5R. As previously indicated, the left loudspeaker 5L converts the surround-effect-added left signal into corresponding sound while the right loudspeaker 5R converts the surround-effect-added right signal into corresponding sound.

Figure 7:
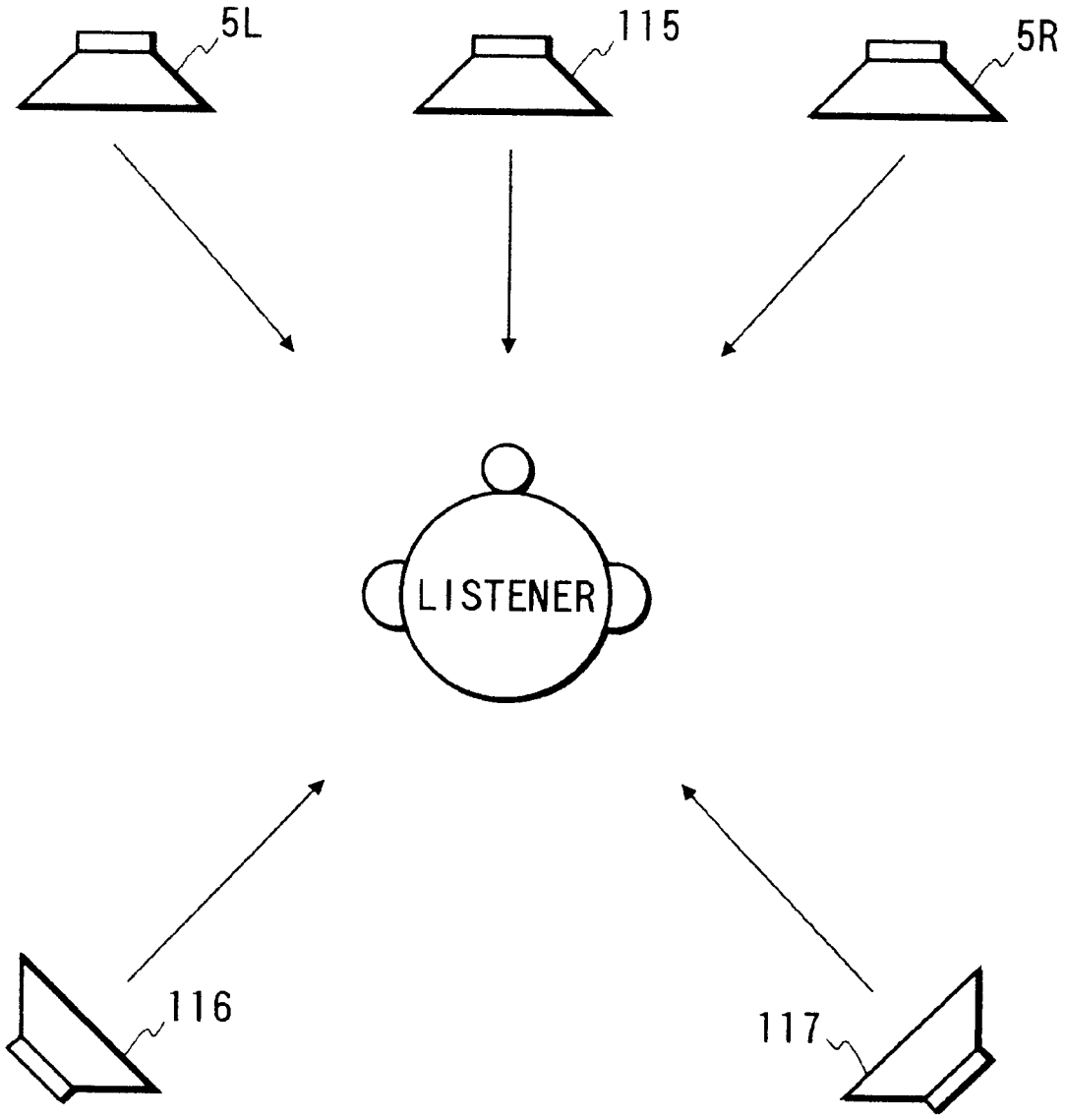
FIG. 7 is a diagram of real and virtual loudspeakers in the system of FIG. 1, and a listener.

As shown in FIG. 7, in addition to real loudspeakers formed by the front left loudspeaker 5L and the front right loudspeaker 5R, there are provided three virtual loudspeakers, that is, a virtual front center loudspeaker 115, a virtual rear left loudspeaker 116, and a virtual rear right loudspeaker 117. The listener can feel as if sound represented by the center signal, sound represented by the left surround signal, and sound represented by the right surround signal are generated by the virtual front center loudspeaker 115, the virtual rear left loudspeaker 116, and the virtual rear right loudspeaker 117, respectively. The positions of the virtual rear left loudspeaker 116 and the virtual rear right loudspeaker 117 are symmetrical with respect to the listener.

In FIG. 2, the blocks 13*a* and 13*b* for the initial reflection sound adding processes are similar to each other in internal design. Accordingly, only the block 13*a* will be explained in detail.

Figure 21:
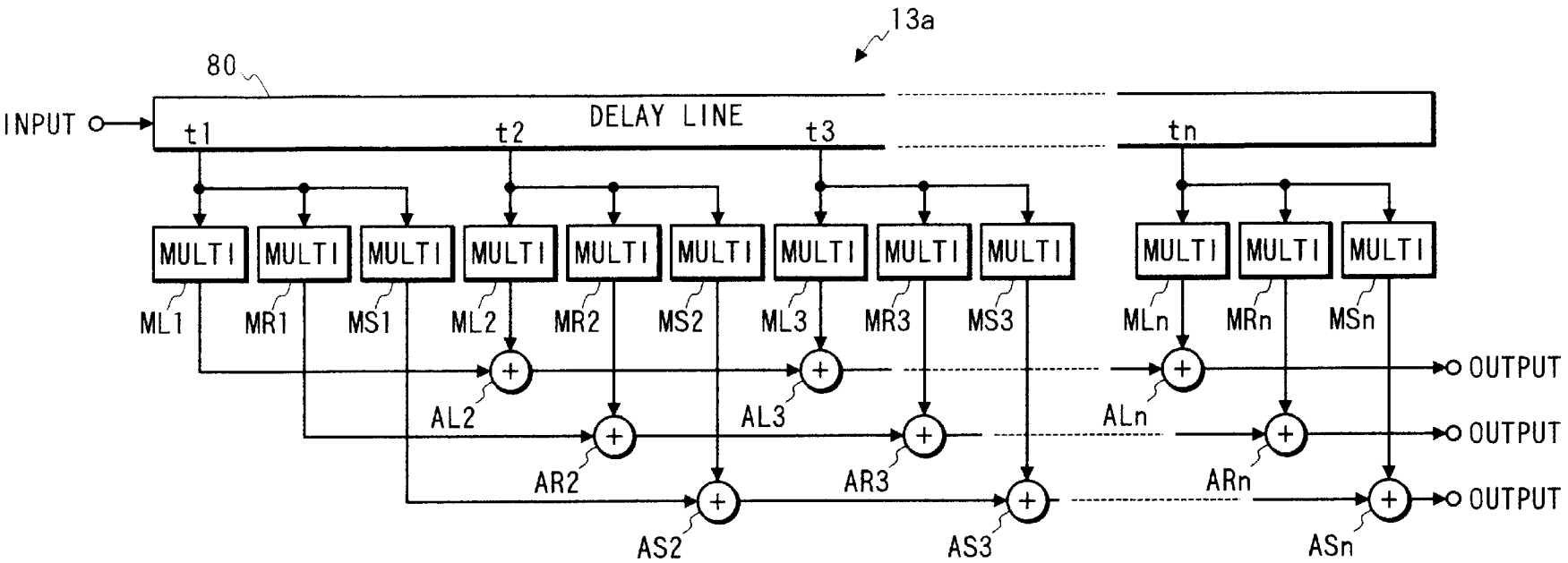
FIG. 21 is an operation flow diagram of an initial reflection sound adding block in FIG. 2.

FIG. 21 shows the details of the block 13*a* for the initial reflection sound adding process. As shown in FIG. 21, the block 13*a* has a delay line step 80 equivalent to a series combination of delay elements. The delay line step 80 operates on the thinning-resultant signal generated by the block 12*a* in FIG. 2. The delay line step 80 has taps t1, t2, t3, . . . , and tn. Coefficient multiplying steps ML1, MR1, and MS1 follow the tap t1 of the delay line step 80.

Coefficient multiplying steps ML2, MR2, and MS2 follow the tap t2 of the delay line step 80. Signals generated by the coefficient multiplying steps ML1 and ML2 are added by an adding step AL2.

Signals generated by the coefficient multiplying steps MR1 and MR2 are added by an adding step AR2. Signals generated by the coefficient multiplying steps MS1 and MS2 are added by an adding step AS2. Coefficient multiplying steps ML3, MR3, and MS3 follow the tap t3 of the delay line step 80. Signals generated by the coefficient multiplying step ML3 and the adding step AL2 are added by an adding step AL3. Signals generated by the coefficient multiplying step MR3 and the adding step AR2 are added by an adding step AR3. Signals generated by the coefficient multiplying step MS3 and the adding step AS2 are added by an adding step AS3. Similar designs are provided for each of the later taps of the delay line step 80. Coefficient multiplying steps MLn, MRn, and MSn follow the tap tn of the delay line step 80. Signals generated by the coefficient multiplying step MLn and the adding step ALn−1 are added by an adding step ALn. Signals generated by the coefficient multiplying step MRn and the adding step ARn−1 are added by an adding step ARn. Signals generated by the coefficient multiplying step MSn and the adding step ASn−1 are added by an adding step ASn. A signal generated by the adding step ALn is used by the block 10*e* in FIG. 2. A signal generated by the adding step ARn is used by the block 10*f* in FIG. 2. A signal generated by the adding step ASn is used by the block 10*c* in FIG. 2.

Figure 22:
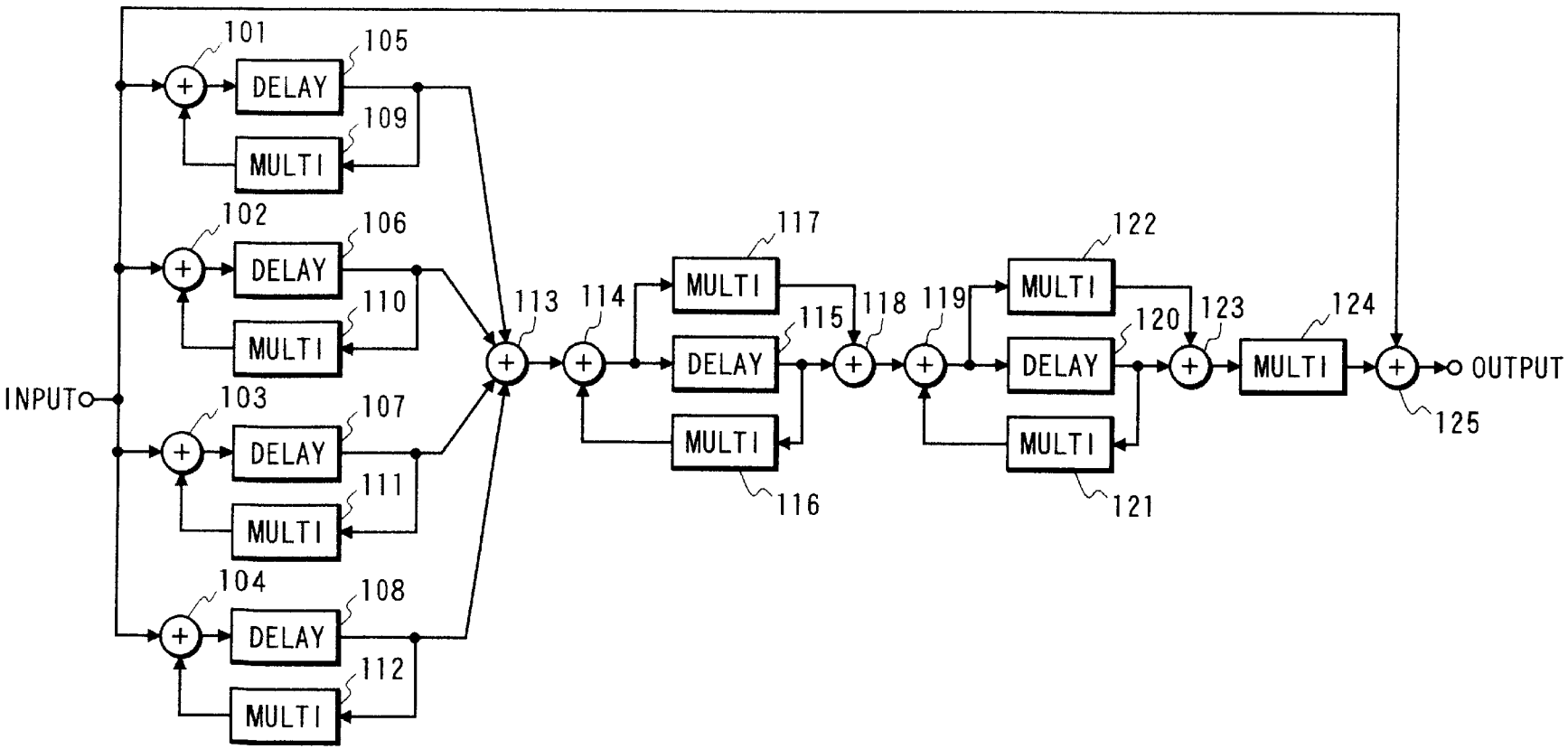
FIG. 22 is an operation flow diagram of a reverberation sound adding block in FIG. 2.

FIG. 22 shows the details of the block 13*c* for the reverberation sound adding process in FIG. 2. As shown in FIG. 22,. the block 13*c* has adding steps 101, 102, 103, and 104 operating on the signal generated by the block 10*b* in FIG. 2. A delay step 105 defers a signal generated by the adding step 101. A delay step 106 defers a signal generated by the adding step 102. A delay step 107 defers a signal generated by the adding step 103. A delay step 108 defers a signal generated by the adding step 104. A coefficient multiplying step 109 follows the delay step 105. A coefficient multiplying step 110 follows the delay step 106. A coefficient multiplying step 111 follows the delay step 107. A coefficient multiplying step 112 follows the delay step 108. The adding step 101 adds the signal generated by the block 10*b* in FIG. 2 and a signal generated by the coefficient multiplying step 109. The adding step 102 adds the signal generated by the block 10*b* in FIG. 2 and a signal generated by the coefficient multiplying step 110. The adding step 103 adds the signal generated by the block 10*b* in FIG. 2 and a signal generated by the coefficient multiplying step 111. The adding step 104 adds the signal generated by the block 10*b* in FIG. 2 and a signal generated by the coefficient multiplying step 112. Signals generated by the delay steps 105, 106, 107, and 108 are added by an adding step 113. An adding step 114 operates on a signal generated by the adding step 113. A delay step 115 defers a signal generated by the adding step 114. A coefficient multiplying step 116 follows the delay step 115. The adding step 114 adds the signal generated by the adding step 113 and a signal generated by the coefficient multiplying step 116. A coefficient multiplying step 117 follows the adding step 114. An adding step 118 adds signals generated by the delay step 115 and the coefficient multiplying step 117. An adding step 119 operates on a signal generated by the adding step 118. A delay step 120 defers a signal generated by the adding step 119. A coefficient multiplying step 121 follows the delay step 120. The adding step 119 adds the signal generated by the adding step 118 and a signal generated by the coefficient multiplying step 121. A coefficient multiplying step 122 follows the adding step 119. An adding step 123 adds signals generated by the delay step 120 and the coefficient multiplying step 122. The adding step 123 is followed by a coefficient multiplying step 124. An adding step 125 adds the signal generated by the block 10*b* in FIG. 2 and a signal generated by the coefficient multiplying step 124. A signal generated by the adding step 125 is used by the block 10*c* in FIG. 2.

Second Embodiment

Figure 8:
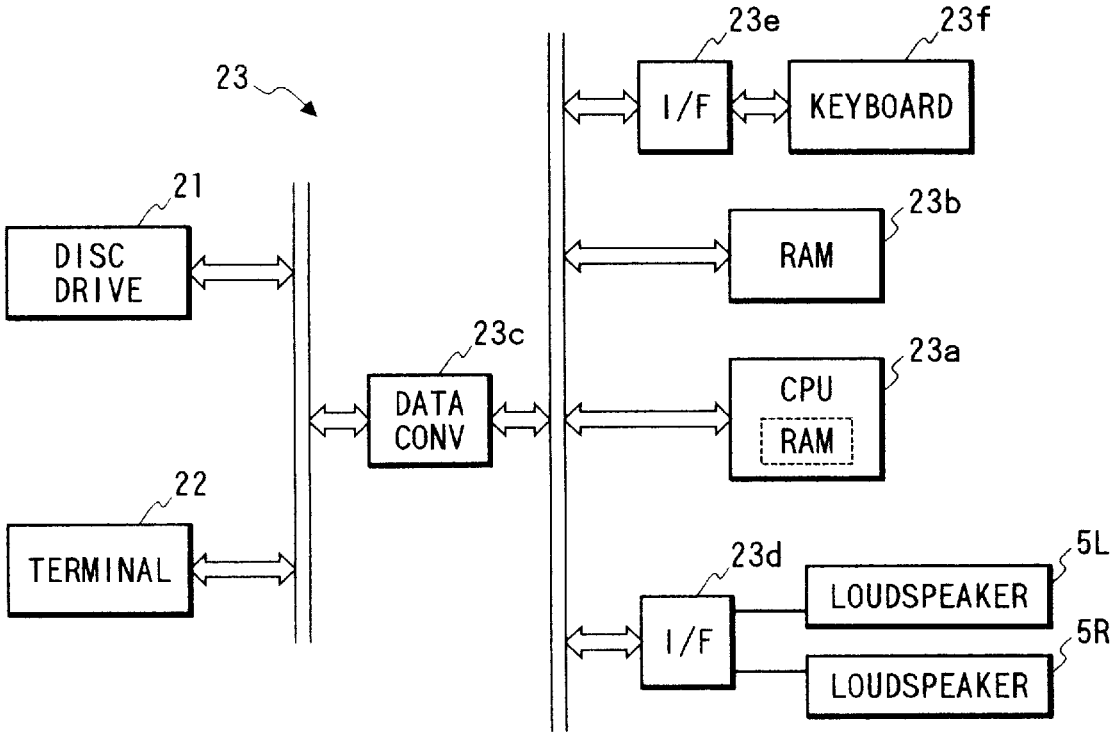
FIG. 8 is a block diagram of a personal computer according to a second embodiment of this invention.

With reference to FIG. 8, a personal computer 23 includes a disc drive 21, a network terminal 22, a CPU 23*a*, a RAM 23*b*, a data converter 23*c*, an audio interface 23*d*, a keyboard interface 23*e*, and a keyboard 23*f*. The disc drive 21, the network terminal 22, and the data converter 23*c* are connected via a bus. The CPU 23*a*, the RAM 23*b*, the data converter 23*c*, the audio interface 23*d*, and the keyboard interface 23*e* are connected via a bus. The CPU 23*a* includes a RAM. The keyboard 23*f* is connected to the keyboard interface 23*e*. The audio interface 23*d* is connected to loudspeakers 5L and 5R. The network terminal 22 is connected to a communication network such as the Internet. The network terminal 22 transmits and receives data to and from the communication network according to a known protocol such as "TCP/IP".

A surround signal processing program is prepared which is designed to implement processes corresponding to operation of the surround signal decoder 2 and the signal processor 3 in FIG. 1. The surround signal processing program is stored in a disc. When the disc is placed in the disc drive 21, the personal computer 23 can read out the surround signal processing program from the disc via the disc drive 21.

Figure 9:
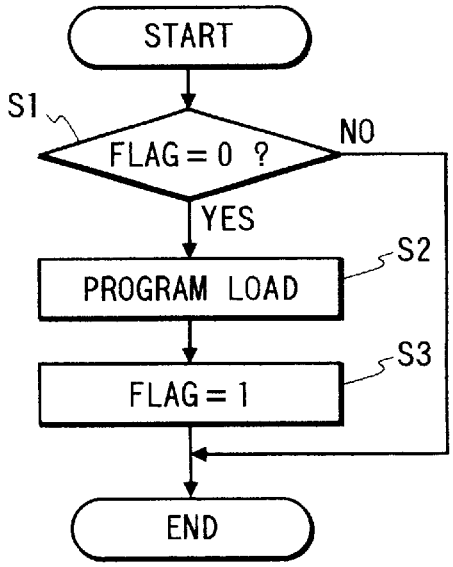
FIG. 9 is a flowchart of a first mode of operation of the personal computer in FIG. 8.

FIG. 9 is a flowchart of a first mode of operation of the personal computer 23 which is started when a program load command is inputted via the keyboard 23*f*. With reference to FIG. 9, a first step Si decides whether or not a program load flag is "0". It should be noted that the program load flag is initially set to "0". The program load flag is designed to indicate whether or not program load is completed. When the program load flag is "0", that is, when the program load is not completed, the operation of the personal computer 23 proceeds from the step S1 to a step S2. Otherwise, the operation of the personal computer 23 exits from the step S1, and then the operation of the personal computer 23 ends.

The step S2 activates the disc drive 21, and reads out the surround signal processing program from a disc in the disc drive 21. The step S2 transmits the surround signal processing program from the disc drive 21 to the RAM within the CPU 23*a* via the data converter 23*c*.

A step S3 following the step S2 sets the program load flag to "1" so that the program load flag will indicate the completion of the program load. After the step S3, the operation of the personal computer 23 ends.

There is a disc as a surround source which stores a pair of a left-channel audio signal and a right-channel audio signal resulting from multiplexing 4-channel signals (that is, a left signal L, a right signal R, a center signal C, and a rear surround signal S). When the disc is placed in the disc drive 21, the personal computer 23 can read out the left-channel audio signal and the right-channel audio signal from the disc via the disc drive 21.

Figure 10:
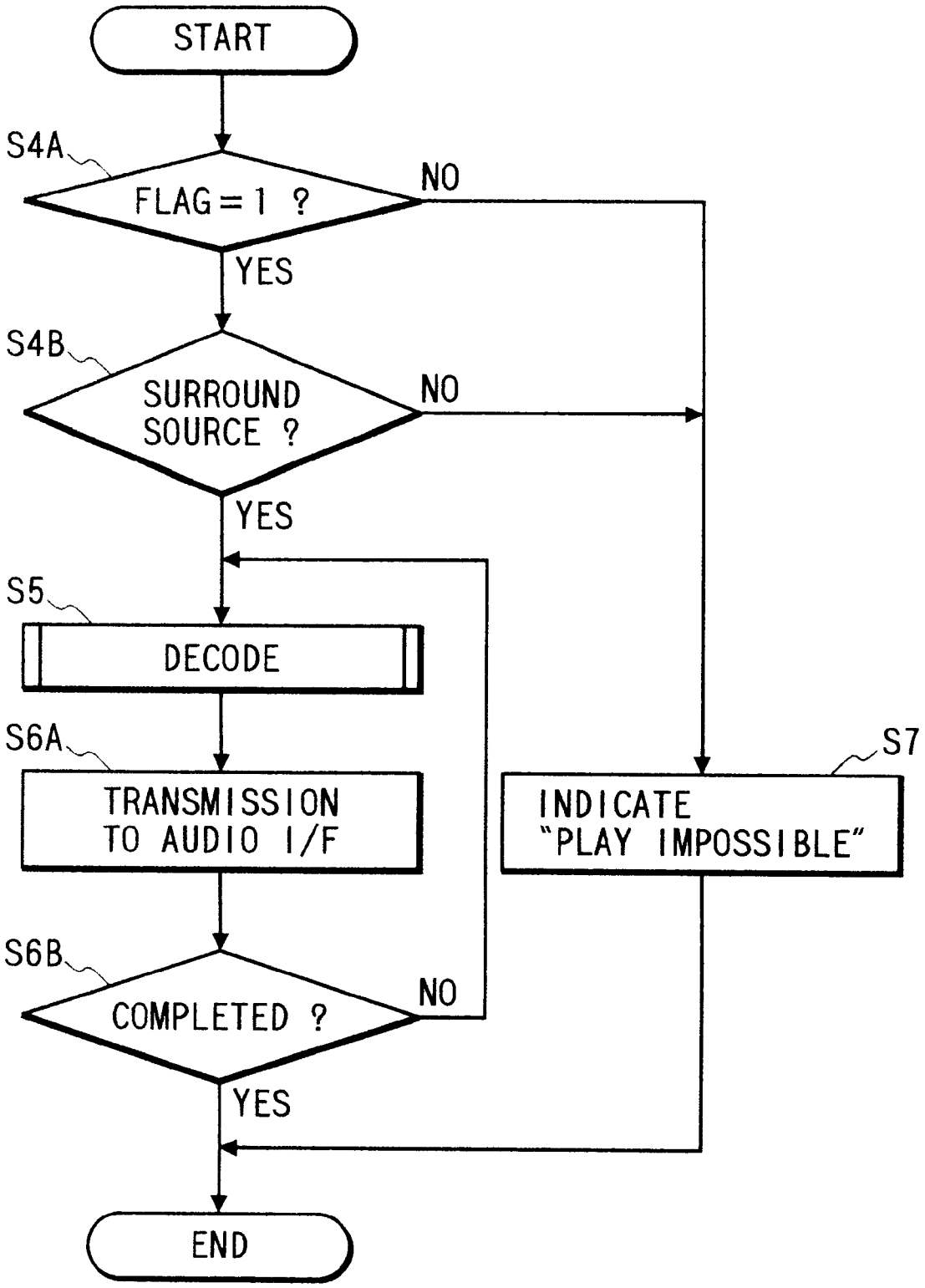
FIG. 10 is a flowchart of a second mode of operation of the personal computer in FIG. 8.

FIG. 10 is a flowchart of a second mode of operation of the personal computer 23 which is started when a disc play command is inputted via the keyboard 23*f*. With reference to FIG. 10, a first step S4A decides whether or not the program load flag is "1". When the program load flag is "1", that is, when the program load is completed, the operation of the personal computer 23 proceeds from the step S4A to a step S4B. Otherwise, the operation of the personal computer 6 proceeds from the step S4A to a step S7.

The step S4B activates the disc drive 21, and accesses a first track of a disc in the disc drive 21 to read out subcode information therefrom. The subcode information represents the type of the disc. The step S4B decides whether or not the type of the disc indicates a surround source. When the type of the disc indicates a surround source, the operation of the personal computer 23 proceeds from the step S4B to a block S5. Otherwise, the operation of the personal computer 23 proceeds from the step S4B to the step S7.

The block S5 activates the disc drive 21, and reads out data from a next track of the disc therein. The block S5 decodes the readout data into 4-channel data pieces, and converts the 4-channel data pieces to 2-channel data pieces according to the surround signal processing program.

A step S6A following the bock S5 transmits the 2-channel data pieces to the audio interface 23*d*. The audio interface 23*d* converts the 2-channel data pieces to corresponding 2-channel analog signals respectively, and feeds the 2-channel analog signals to the loudspeakers 5L and 5R respectively.

A step S6B subsequent to the step S6A decides whether or not a final track of the disc in the disc drive 21 has been accessed. When the final track of the disc in the disc drive 21 has not yet been accessed, the operation of the personal computer 23 returns from the step S6B to the block S5. When the final track of the disc in the disc drive 21 has been accessed, the operation of the personal computer 23 exits from the step S6B and then ends.

The step S7 controls a display (not shown) to indicate "play impossible" on the display. After the step S7, the operation of the personal computer 23 ends.

Figure 11:
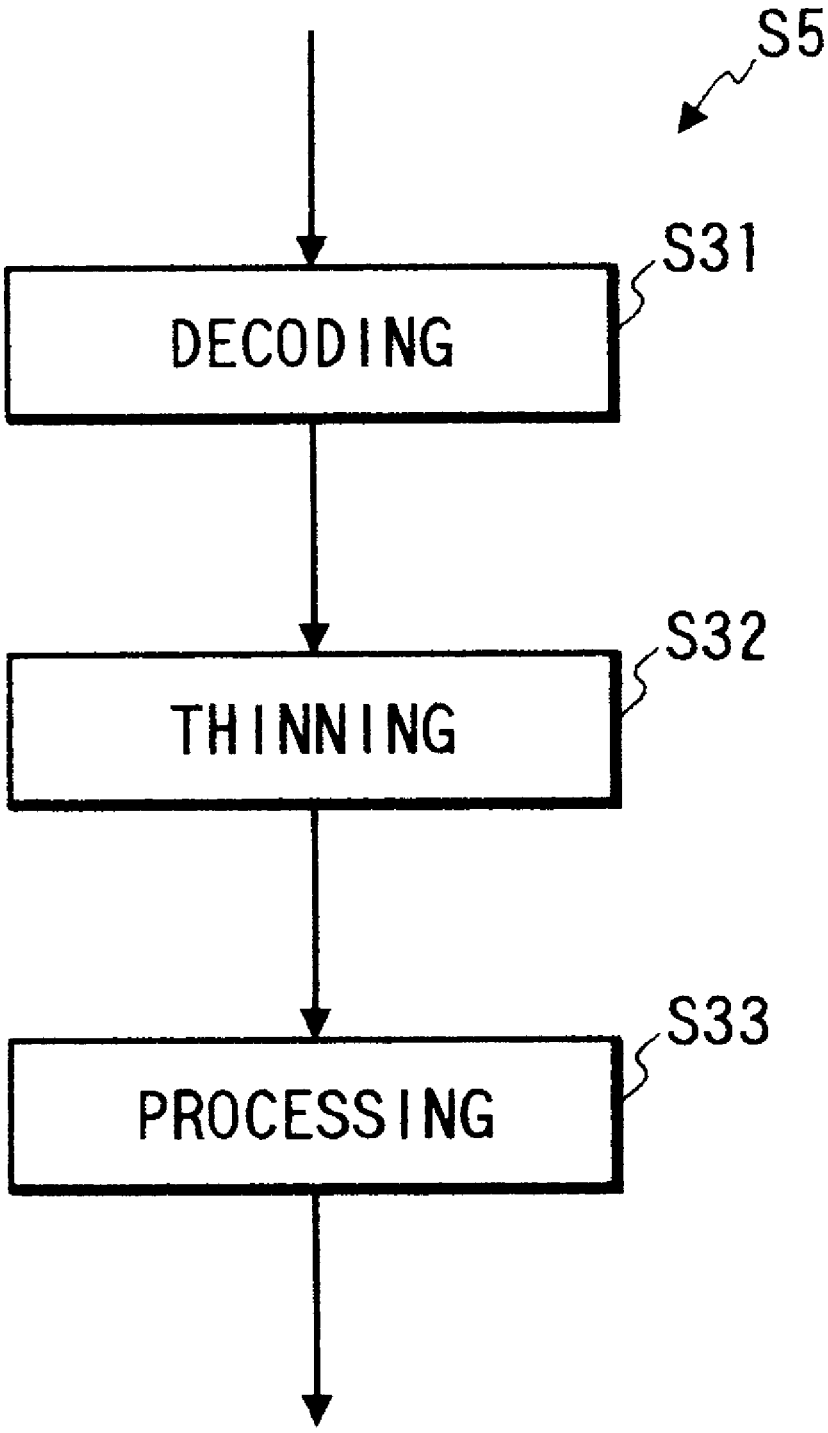
FIG. 11 is a flow diagram of the details of a block in FIG. 10.

As shown in FIG. 11, the block S5 has a sequence of steps S31, S32, and 833. The first step S31 in the block S5 decodes the readout data into 4-channel data pieces in a known way given by the surround signal processing program. The 4-channel data pieces are a left data piece, a right data piece, a center data piece, and a rear surround data piece (a rear data piece). The step S31 corresponds to the surround signal decoder 2 in FIG. 1.

According to the surround signal processing program, the step S32 following the step S31 subjects the left data piece, the right data piece, the center data piece, and the rear surround data piece (the rear data piece) to an addition process, low pass filtering processes, and thinning processes which correspond to the bocks 10*a*, 11*a*, 11*b*, 12*a*, and 12*b* in FIG. 2.

According to the surround signal processing program, the step S33 subsequent to the step S32 subjects the thinning-resultant signals to processes including initial reflection sound adding processes, a reverberation sound adding process, and a sound image localizing process which correspond to the blocks 13*a*, 13*b*, 13*c*, and 14 in FIG. 2. In addition, the processes implemented by the step S33 include interpolation processes and low pass filtering processes corresponding to the blocks 15*a*, 15*b*, 15*c*, 11*c*, 11*d*, and 11*e* in FIG. 2. The step S33 corresponds to the blocks 10*b*, 10*c*, 10*d*, 10*e*, 10*f*, 10*g*, 10*h*, 10*i*, 11*c*, 11*d*, 11*e*, 13*a*, 13*b*, 13*c*, 14, 15*a*, 15*b*, and 15*c* in FIG. 2. Finally, the step S33 generates a surround-effect-added left signal and a surround-effect-added right signal which correspond to the addition-resultant signals generated by the blocks 10*h* and 10*i* in FIG. 2, respectively.

Third Embodiment

Figure 12:
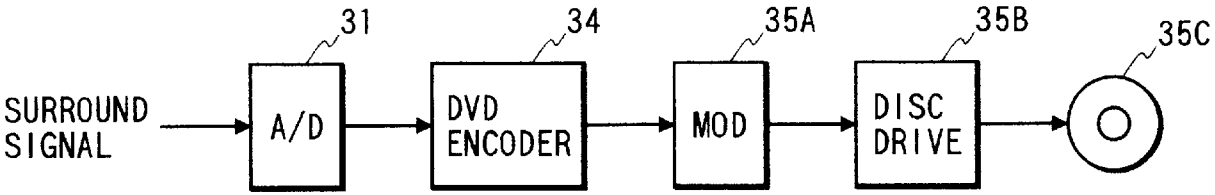
FIG. 12 is a block diagram of a recording apparatus in a third embodiment of this invention.

With reference to FIG. 12, an A/D converter 31 receives an analog multiplexing-resultant surround signal which is generated by encoding and multiplexing a left-channel audio signal, a right-channel audio signal, a center-channel audio signal, and a rear-channel audio signal (a rear surround signal) in a known way. Generally, the analog multiplexing-resultant surround signal has two channels, that is, a left channel and a right channel. The A/D converter 31 changes the analog multiplexing-resultant surround signal into a corresponding digital signal.

The digital signal is outputted from the A/D converter 31 to a DVD (digital video disc) encoder 34. The digital signal is encoded into a signal of the DVD format by the DVD encoder 34. The DVD-format signal is outputted from the DVD encoder 34 to a modulation circuit 35A. The DVD-format signal is subjected by the modulation circuit 35A to modulation for record. The modulation circuit 35A outputs the modulation-resultant signal to a disc drive 35B. The disc drive 35B records the modulation-resultant signal on a recording medium 35C such as a DVD or a master recording medium.

Figure 13:
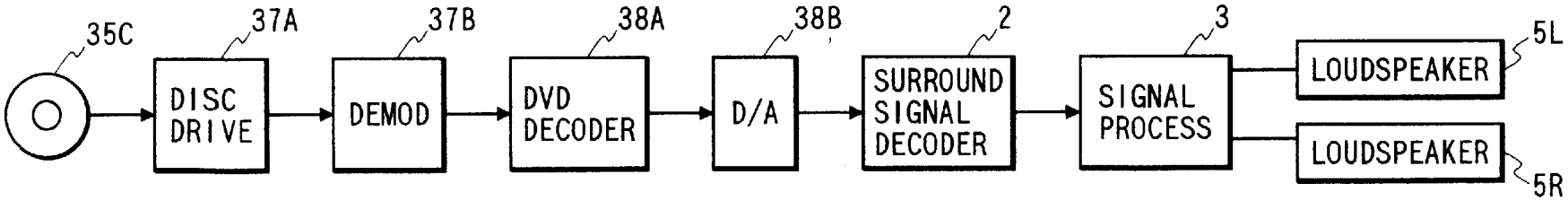
FIG. 13 is a block diagram of a reproducing apparatus in the third embodiment of this invention.

With reference to FIG. 13, a disc drive 37A reproduces a signal from a recording medium 35C such as a DVD. The disc drive 37A outputs the reproduced signal to a demodulation circuit 37B. The demodulation circuit 37B demodulates the reproduced signal into a DVD-format signal. The demodulation circuit 37B outputs the DVD-format signal to a DVD decoder 38A. The DVD decoder 38A decodes the DVD-format signal into a digital multiplexing-resultant surround signal. The DVD decoder 38A outputs the digital multiplexing-resultant surround signal to a D/A converter 38B. The D/A converter 38B changes the digital multiplexing-resultant surround signal into a corresponding analog multiplexing-resultant surround signal having two channels. The D/A converter 38B outputs the analog multiplexing-resultant surround signal to a surround signal decoder 2 which is the same as that in FIG. 1.

The surround signal decoder 2 decodes the analog multiplexing-resultant surround signal into a left signal L, a right signal R, a center signal C, and a rear signal (a rear surround signal) S in a known way. The surround signal decoder 2 outputs the left signal L, the right signal R, the center signal C, and the rear signal S to a signal processor 3 which is the same as that in FIG. 1.

The signal processor 3 converts the left signal L, the right signal R, the center signal C, and the rear signal S into a pair of a surround-effect-added left signal and a surround-effect-added right signal. The signal processor 3 outputs the surround-effect-added left signal and the surround-effect-added right signal to a left loudspeaker 5L and a right loudspeaker 5R, respectively.

The left loudspeaker 5L converts the surround-effect-added left signal into corresponding sound. The right loudspeaker 5R converts the surround-effect-added right signal into corresponding sound.

Fourth Embodiment

A fourth embodiment of this invention is similar to the second embodiment thereof except for design changes indicated hereinafter.

Figure 14:
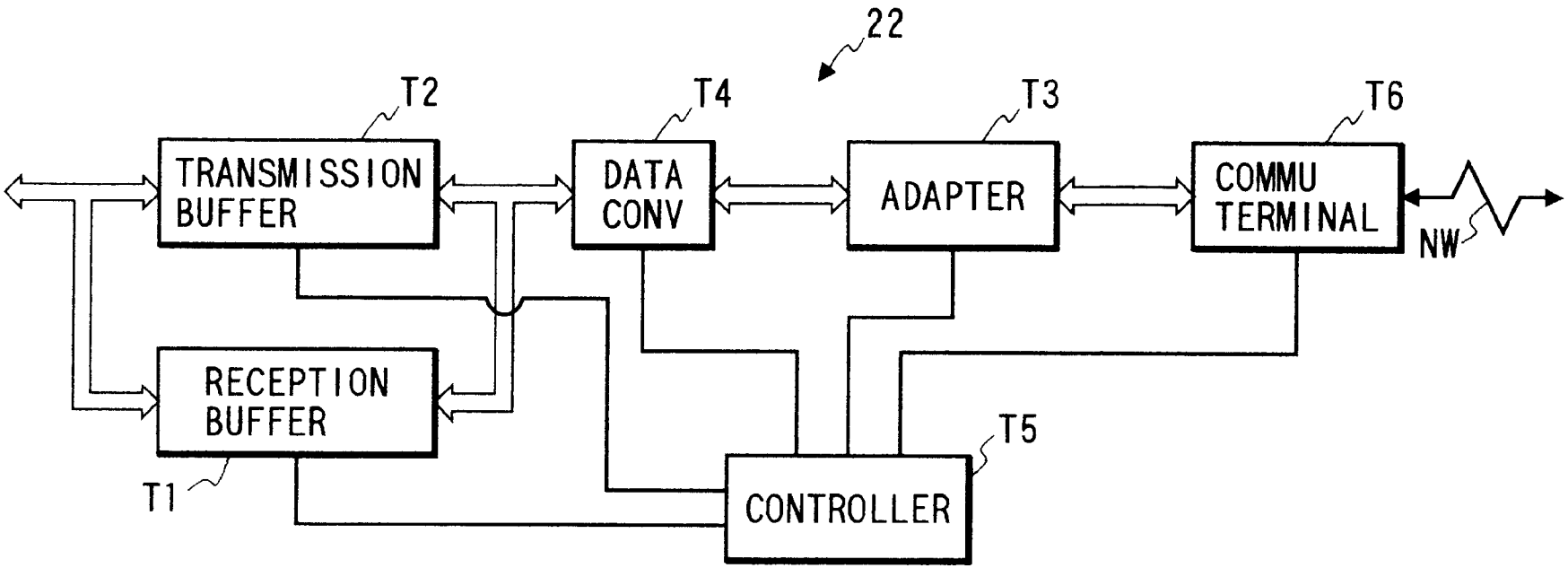
FIG. 14 is a block diagram of a network terminal in a fourth embodiment of this invention.

With reference to FIG. 14, the network terminal 22 (see FIG. 8) includes a reception buffer T1, a transmission buffer T2, an adapter T3, a data converter T4, a controller T5, and a communication terminal T6. The reception buffer T1 and the transmission buffer T2 are connected between the data converter T4 and the bus within the personal computer 23 (see FIG. 8). The data converter T4 is connected via the adapter T3 to the communication terminal T6. The communication terminal T6 is connected to the communication network NW such as the Internet or a CATV network. The controller T5 is connected to the reception buffer T1, the transmission buffer T2, the adapter T3, the data converter T4, and the communication terminal T6. The controller T5 serves to control the reception buffer T1, the transmission buffer T2, the adapter T3, the data converter T4, and the communication terminal T6.

The controller T5 includes a microcomputer, a digital signal processor, or a similar device which has a combination of an input/output port, a processing section, a ROM, and a RAM. The controller T5 operates in accordance with a control program stored in the ROM.

The personal computer 23 (see FIG. 8) can read out a surround signal processing program from a disc via the disc drive 21 (see FIG. 8). The personal computer 23 can transmit the surround signal processing program to the communication network NW via the network terminal 22.

Figure 15:
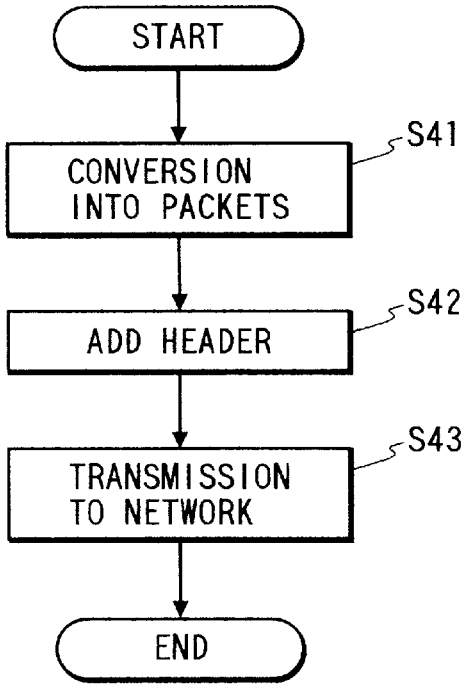
FIG. 15 is a flowchart of a first segment of a program for a controller in FIG. 14.

FIG. 15 is a flowchart of a segment of the control program for the controller T5 which relates to the transmission of a surround signal processing program to the communication network NW. With reference to FIG. 15, a first step S41 of the control program segment transmits the surround signal processing program to the data converter T4 via the transmission buffer T2. The step S41 controls the data converter T4 so that a bit sequence representing the surround signal processing program will be divided into packets having equal sizes.

A step S42 following the step S41 generates a header containing destination information for each of the packets.

The step S42 controls the data converter T4 so that the headers will be added to the packets respectively. Accordingly, a stream of the header-added packets is generated.

A step S43 subsequent to the step S42 controls the adapter T3 and the communication terminal T6 so that the stream of the header-added packets will be transmitted from the data converter T4 to the communication network NW via the adapter T3 and the communication terminal T6. The step S43 controls the adapter T3 to execute a communication protocol with the communication opposite party. After the step S43, the control program segment ends.

The personal computer 23 (see FIG. 8) can receive a surround signal processing program from the communication network NW via the network terminal 22 (see FIG. 8).

Figure 16:
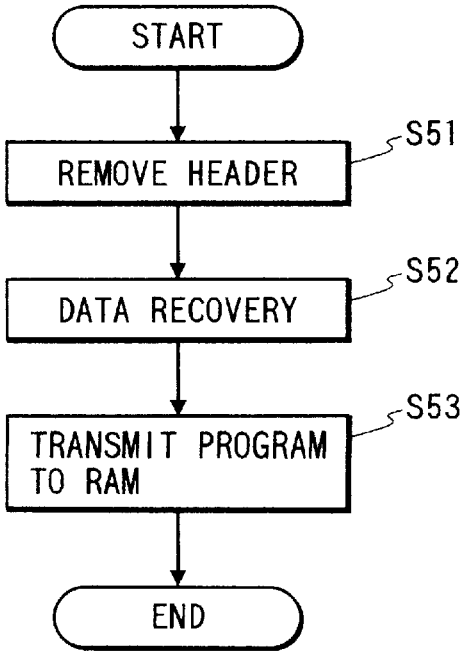
FIG. 16 is a flowchart of a second segment of the program for the controller in FIG. 14.

FIG. 16 is a flowchart of a segment of the control program for the controller T5 which relates to the reception of a surround signal processing program from the communication network NW. A stream of header-added packets which represents the surround signal processing program is transmitted from the communication network NW to the data converter T4 via the communication terminal T6 and the adapter T3.

With reference to FIG. 16, a first step S51 of the control program segment controls the data converter T4 so that headers will be removed from the packets respectively.

A step S52 following the step S51 controls the data converter T4 so that the header-free packets will be combined into a bit sequence representing the surround signal processing program.

A step S53 subsequent to the step S52 controls the data converter T4 and the reception buffer T1 so that the bit sequence of the surround signal processing program will be transmitted from the data converter T4 to a RAM within the personal computer 23, for example, the RAM within the CPU 23*a* (see FIG. 8), via the reception buffer T1.

Fifth Embodiment

Figure 17:
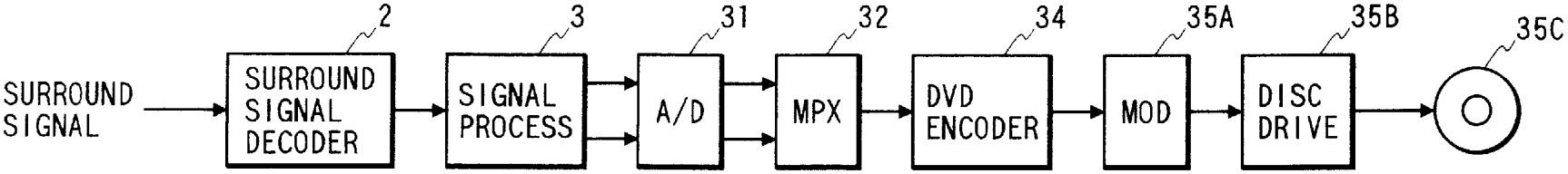
FIG. 17 is a block diagram of a recording apparatus in a fifth embodiment of this invention.

With reference to FIG. 17, a multiplexing-resultant surround signal is inputted into a surround signal decoder 2 which is the same as that in FIG. 1. The surround signal decoder 2 decodes the multiplexing-resultant surround signal into a left signal L, a right signal R, a center signal C, and a rear signal (a rear surround signal) S. The surround signal decoder 2 outputs the left signal L, the right signal R, the center signal C, and the rear signal S to a signal processor 3 which is the same as that in FIG. 1. The signal processor 3 converts the left signal L, the right signal R, the center signal C, and the rear signal S into surround-effect-added 2-channel analog signals. The signal processor 3 outputs the 2-channel analog signals.

An A/D converter 31 follows the signal processor 3. The A/D converter 31 receives the 2-channel analog signals, and converts the 2-channel analog signals into corresponding 2-channel digital signals. The A/D converter 31 outputs the 2-channel digital signals to a multiplexer 32. The multiplexer 32 combines the 2-channel digital signals into a single digital signal. The multiplexer 32 outputs the single digital signal.

A DVD (digital video disc) encoder 34 follows the multiplexer 32. The output signal of the multiplexer 32 is encoded into a signal of the DVD format by the DVD encoder 34. The DVD-format signal is outputted from the DVD encoder 34 to a modulation circuit 35A. The DVD-format signal is subjected by the modulation circuit 35A to modulation for record. The modulation circuit 35A outputs the modulation-resultant signal to a disc drive 35B. The disc drive 35B records the modulation-resultant signal on a recording medium 35C such as a DVD or a master recording medium.

Figure 18:
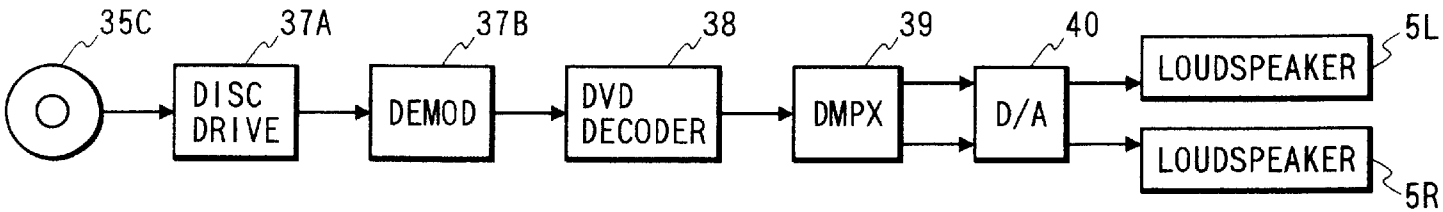
FIG. 18 is a block diagram of a reproducing apparatus in the fifth embodiment of this invention.

With reference to FIG. 18, a disc drive 37A reproduces a signal from a recording medium 35C such as a DVD. The disc drive 37A outputs the reproduced signal to a demodulation circuit 37B. The demodulation circuit 37B demodulates the reproduced signal into a DVD-format signal. The demodulation circuit 37B outputs the DVD-format signal to a DVD decoder 38. The DVD decoder 38 decodes the DVD-format signal into a multiplexing-resultant signal. The DVD decoder 38 outputs the multiplexing-resultant signal to a demultiplexer 39. The demultiplexer 39 separates the multiplexing-resultant signal into 2-channel digital signals. The demultiplexer 39 outputs the 2-channel digital signals to a D/A converter 40. The D/A converter 40 changes the 2-channel digital signals into corresponding 2-channel analog signals. The D/A converter 40 outputs the 2-channel analog signals to loudspeakers 5L and 5R respectively.

Sixth Embodiment

Figure 19:
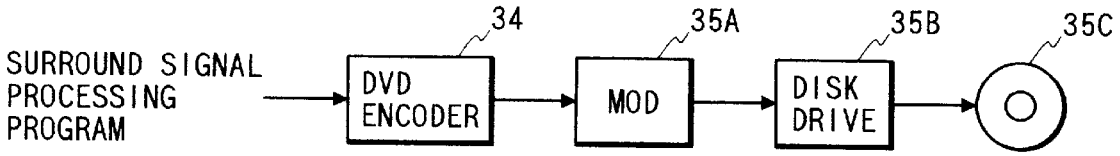
FIG. 19 is a block diagram of a recording apparatus in a sixth embodiment of this invention.

With reference to FIG. 19, a bit sequence representing a surround signal processing program is inputted into a DVD (digital video disc) encoder 34. For example, the bit sequence of the surround signal processing program is received from a communication network via a personal computer. The bit sequence of the surround signal processing program is encoded into a signal of the DVD format by the DVD encoder 34. The DVD-format signal is outputted from the DVD encoder 34 to a modulation circuit 35A. The DVD-format signal is subjected by the modulation circuit 35A to modulation for record. The modulation circuit 35A outputs the modulation-resultant signal to a disc drive 35B. The disc drive 35B records the modulation-resultant signal on a recording medium 35C such as a DVD or a master recording medium. In this way, information of the surround signal processing program is recorded on the recording medium 35C.

Figure 20:
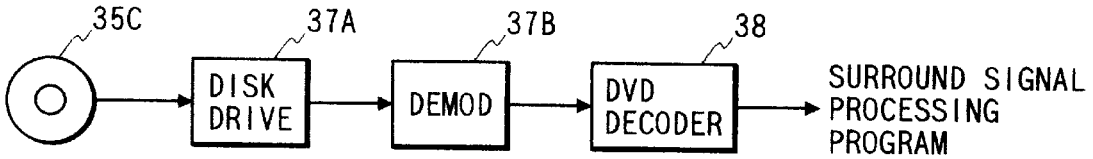
FIG. 20 is a block diagram of a reproducing apparatus in the sixth embodiment of this invention.

With reference to FIG. 20, a disc drive 37A reproduces a signal from a recording medium 35C such as a DVD. The disc drive 37A outputs the reproduced signal to a demodulation circuit 37B. The demodulation circuit 37B demodulates the reproduced signal into a DVD-format signal. The demodulation circuit 37B outputs the DVD-format signal to a DVD decoder 38. The DVD decoder 38 decodes the DVD-format signal into a bit sequence representing a surround signal processing program. The DVD decoder 38 outputs the bit sequence of the surround signal processing program. The bit sequence of the surround signal processing program may be transmitted to a communication network via a personal computer.

What is claimed is:

1. A surround signal processing system comprising:

first means for decoding a multiplexing-resultant surround signal into multiple-channel signals including at least a first left-channel signal, a first right-channel signal, and a rear-channel signal;

second means for thinning out samples of the rear-channel signal generated by the first means in density to generate a thinning-resultant rear-channel signal;

third means for subjecting the thinning-resultant rear-channel signal to a given process to convert the thinning-resultant rear-channel signal into a left surround-related signal and a right surround-related signal, the given process being designed to localize sound images at rear positions with respect to a listener when a rear loudspeaker is absent and only front loudspeakers are used;

fourth means for generating a surround-effect-added left-channel signal on the basis of the first left-channel signal generated by the first means and the left surround-related signal generated by the third means; and fifth means for generating a surround-effect-added right-channel signal on the basis of the first right-channel signal generated by the first means and the right surround-related signal generated by the third means.

2. A surround signal processing system as recited in claim 1, wherein the second means comprises means for decimating the samples of the rear-channel signal at a predetermined rate.

3. A surround signal processing system as recited in claim 1, wherein the second means comprises means for discarding first alternate ones of the samples of the rear-channel signal and selecting second alternate ones of the samples of the rear-channel signal.

4. A method of processing a surround signal, comprising the steps of:

decoding a multiplexing-resultant surround signal into multiple-channel signals including at least a first left-channel signal, a first right-channel signal, and a rear-channel signal;

thinning out samples of the rear-channel signal generated by the decoding step in density to generate a thinning-resultant rear-channel signal;

subjecting the thinning-resultant rear-channel signal to a given process to convert the thinning-resultant rear-channel signal into a left surround-related signal and a right surround-related signal, the given process being designed to localize sound images at rear positions with respect to a listener when a rear loudspeaker is absent and only front loudspeakers are used;

generating a surround-effect-added left-channel signal on the basis of the first left-channel signal generated by the decoding step and the left surround-related signal generated by the subjecting step; and generating a surround-effect-added right-channel signal on the basis of the first right-channel signal generated by the decoding step and the right surround-related signal generated by the subjecting step.

5. A method as recited in claim 4, wherein the thinning-out step comprises decimating the samples of the rear-channel signal at a predetermined rate.

6. A method as recited in claim 4, wherein the thinning-out step comprises discarding first alternate ones of the samples of the rear-channel signal and selecting second alternate ones of the samples of the rear-channel signal.

7. An information recording medium which stores a program of processing a multiplexing-resultant surround signal, the program including a step of decoding a multiplexing-resultant surround signal into multiple-channel signals including at least a first left-channel signal, a second right-channel signal, and a rear-channel signal; a step of thinning out samples of the rear-channel signal generated by the decoding step in density to generate a thinning-resultant rear-channel signal; a step of subjecting the thinning-resultant rear-channel signal to a given process to convert the thinning-resultant rear-channel signal into a left surround-related signal and a right surround-related signal, the given process being designed to localize sound images at rear positions with respect to a listener when a rear loudspeaker is absent and only front loudspeakers are used; a step of generating a surround-effect-added left-channel signal on the basis of the first left-channel signal generated by the decoding step and the left surround-related signal generated by the subjecting step; and a step of generating a surround-effect-added right-channel signal on the basis of the first right-channel signal generated by the decoding step and the right surround-related signal generated by the subjecting step.

8. An information recording medium as recited in claim 7, wherein the thinning-out step comprises decimating the samples of the rear-channel signal at a predetermined rate.

9. An information recording medium as recited in claim 7, wherein the thinning-out step comprises discarding first alternate ones of the samples of the rear-channel signal and selecting second alternate ones of the samples of the rear-channel signal.

10. A transmission system for a surround signal processing program, comprising:

first meas for storing a program of processing a surround signal, the program including a step of decoding a multiplexing-resultant surround signal into multiple-channel signals including at least a first left-channel signal, a first right-channel signal, and a rear-channel signal; a step of thinning out samples of the rear-channel signal generated by the decoding step in density to generate a thinning-resultant rear-channel signal; a step of subjecting the thinning-resultant rear-channel signal to a given process to convert the thinning-resultant rear-channel signal into a left surround-related signal and a right surround-related signal, the given process being designed to localize sound images at rear positions with respect to a listener when a rear loudspeaker is absent and only front loudspeakers are used; a step of generating a surround-effect-added left-channel signal on the basis of the first left-channel signal generated by the decoding step and the left surround-related signal generated by the subjecting step; and a step of generating a surround-effect-added right-channel signal on the basis of the first right-channel signal generated by the decoding step and the right surround-related signal generated by the subjecting step;

a terminal device connected to a communication network; and second means connected to the first means and the terminal device for transmitting the program from the first means to the communication network via the terminal device.

11. A transmission system as recited in claim 10, wherein the thinning-out step comprises decimating the samples of the rear-channel signal at a predetermined rate.

12. A transmission system as recited in claim 10, wherein the thinning-out step comprises discarding first alternate ones of the samples of the rear-channel signal and selecting second alternate ones of the samples of the rear-channel signal.

13. A reception system for a surround signal processing program, comprising:

a terminal device connected to a communication network; and means connected to the terminal device for receiving a program from the communication network via the terminal device;

wherein the program includes a step of decoding a multiplexing-resultant surround signal into multiple-channel signals including at least a first left-channel signal, a first right-channel signal, and a rear-channel signal; a step of thinning out samples of the rear-channel signal generated by the decoding step in density to generate a thinning-resultant rear-channel signal; a step of subjecting the thinning-resultant rear-channel signal to a given process to convert the thinning-resultant rear-channel signal into a left surround-related signal and a right surround-related signal, the given process being designed to localize sound images at rear positions with respect to a listener when a rear loudspeaker is absent and only front loudspeakers are used; a step of generating a surround-effect-added left-channel signal on the basis of the first left-channel signal generated by the decoding step and the left surround-related signal generated by the subjecting step; and a step of generating a surround-effect-added right-channel signal on the basis of the first right-channel signal generated by the decoding step and the right surround-related signal generated by the subjecting step.

14. A reception system as recited in claim 13, wherein the thinning-out step comprises decimating the samples of the rear-channel signal at a predetermined rate.

15. A reception system as recited in claim 13, wherein the thinning-out step comprises discarding first alternate ones of the samples of the rear-channel signal and selecting second alternate ones of the samples of the rear-channel signal.

16. A recording apparatus for a surround signal, comprising:

first means for decoding a multiplexing-resultant surround signal into multiple-channel signals including at least a first left-channel signal, a first right-channel signal, and a rear-channel signal;

second means for thinning out samples of the rear-channel signal generated by the first means in density to generate a thinning-resultant rear-channel signal;

third means for subjecting the thinning-resultant rear-channel signal to a given process to convert the thinning-resultant rear-channel signal into a left surround-related signal and a right surround-related signal, the given process being designed to localize sound images at rear positions with respect to a listener when a rear loudspeaker is absent and only front loudspeakers are used;

fourth means for generating a surround-effect-added left-channel signal on the basis of the first left-channel signal generated by the first means and the left surround-related signal generated by the third means;

fifth means for generating a surround-effect-added right-channel signal on the basis of the first right-channel signal generated by the first means and the right surround-related signal generated by the third means; and sixth means for recording the surround-effect-added left-channel signal and the surround-effect-added right-channel signal on a recording medium.

17. A recording apparatus as recited in claim 16, wherein the second means comprises means for decimating the samples of the rear-channel signal at a predetermined rate.

18. A recording apparatus as recited in claim 16, wherein the second means comprises means for discarding first alternate ones of the samples of the rear-channel signal and selecting second alternate ones of the samples of the rear-channel signal.

19. A method of recording a surround signal, comprising the steps of:

decoding a multiplexing-resultant surround signal into multiple-channel signals including at least a first left-channel signal, a first right-channel signal, and a rear-channel signal;

thinning out samples of the rear-channel signal generated by the decoding step in density to generate a thinning-resultant rear-channel signal;

subjecting the thinning-resultant rear-channel signal to a given process to convert the thinning-resultant rear-channel signal into a left surround-related signal and a right surround-related signal, the given process being designed to localize sound images at rear positions with respect to a listener when a rear loudspeaker is absent and only front loudspeakers are used;

generating a surround-effect-added left-channel signal on the basis of the first left-channel signal generated by the decoding step and the left surround-related signal generated by the subjecting step;

generating a surround-effect-added right-channel signal on the basis of the first right-channel signal generated by the decoding step and the right surround-related signal generated by the subjecting step; and recording the surround-effect-added left-channel signal and the surround-effect-added right-channel signal on a recording medium.

20. A method as recited in claim 19, wherein the thinning-out step comprises decimating the samples of the rear-channel signal at a predetermined rate.

21. A method as recited in claim 19, wherein the thinning-out step comprises discarding first alternate ones of the samples of the rear-channel signal and selecting second alternate ones of the samples of the rear-channel signal.

22. A recording apparatus for a surround signal processing program, comprising:

first means for encoding a surround signal processing program into an encoding-resultant signal having a form suited for record; and second means for recording the encoding-resultant signal generated by the first means on an information recording medium;

wherein the surround signal processing program includes a step of decoding a multiplexing-resultant surround signal into multiple-channel signals including at least a first left-channel signal, a first right-channel signal, and a rear-channel signal; a step of thinning out samples of the rear-channel signal generated by the decoding step in density to generate a thinning-resultant rear-channel signal; a step of subjecting the thinning-resultant rear-channel signal to a given process to convert the thinning-resultant rear-channel signal into a left surround-related signal and a right surround-related signal, the given process being designed to localize sound images at rear positions with respect to a listener when a rear loudspeaker is absent and only front loudspeakers are used; a step of generating a surround-effect-added left-channel signal on the basis of the first left-channel signal generated by the decoding step and the left surround-related signal generated by the subjecting step; and a step of generating a surround-effect-added right-channel signal on the basis of the first right-channel signal generated by the decoding step and the right surround-related signal generated by the subjecting step.

23. A recording apparatus as recited in claim 22, wherein the thinning-out step comprises decimating the samples of the rear-channel signal at a predetermined rate.

24. A recording apparatus as recited in claim 22, wherein thinning-out step comprises discarding first alternate ones of the samples of the rear-channel signal and selecting second alternate ones of the samples of the rear-channel signal.

* * * * *